United States Patent [19]

Köster et al.

[11] 4,172,600

[45] Oct. 30, 1979

[54] SEALING BODY ASSEMBLY FOR USE WITH SUPPORT STRUCTURES IN CONJUNCTION WITH AN ELASTOMERIC PRESSURE CUSHION

[75] Inventors: Waldemar Köster, Forsbach, Fed. Rep. of Germany; Reinhold Huber, Rorbas, Switzerland

[73] Assignee: Kober A.G., Glarus, Switzerland

[21] Appl. No.: 907,896

[22] Filed: May 19, 1978

[30] Foreign Application Priority Data

Jun. 7, 1977 [DE] Fed. Rep. of Germany ..... 2725621

[51] Int. Cl.[2] ..... F16J 15/14; E01D 19/04; F16J 15/06

[52] U.S. Cl. ..... 277/199; 14/16.1; 277/188 A

[58] Field of Search ..... 277/12, 188 A, 199; 14/1, 16, 16.1, 16.5, 26, 35, 73, 75

[56] References Cited

U.S. PATENT DOCUMENTS

| | | | |
|---|---|---|---|
| 3,728,752 | 4/1973 | Andra et al. | 14/16.1 |
| 3,934,295 | 1/1976 | Köster et al. | 14/16.1 |
| 3,995,915 | 12/1976 | Köster et al. | 14/16.1 X |

FOREIGN PATENT DOCUMENTS

| | | | |
|---|---|---|---|
| 2152979 | 5/1973 | Fed. Rep. of Germany | 14/16 B |
| 1062751 | 3/1967 | United Kingdom | 14/16.5 |

*Primary Examiner*—Robert S. Ward, Jr.

[57] ABSTRACT

A sealing body assembly for use in sealing the clearance between adjacent parts of a support structure such as a bridge and an elastomeric pressure cushion includes a plurality of sealing elements linked together releasably. The sealing elements are at least partially embedded in the elastomeric pressure cushion. The sealing elements are releasably connected by cooperable stud elements and recesses formed in opposed projections of such sealing elements.

10 Claims, 3 Drawing Figures

Figure 2:
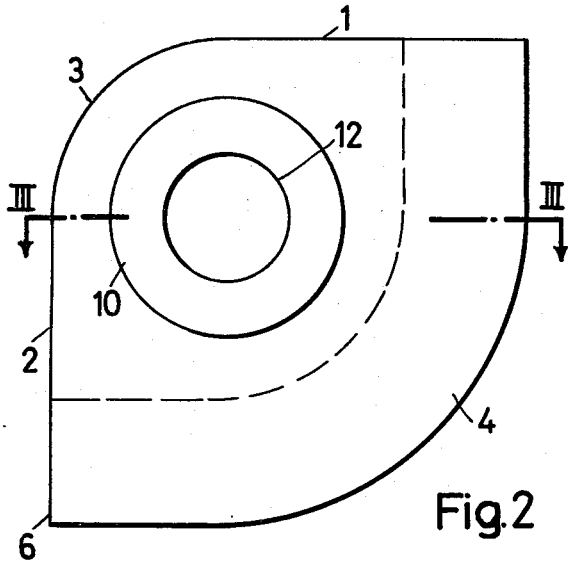

SEALING BODY ASSEMBLY FOR USE WITH SUPPORT STRUCTURES IN CONJUNCTION WITH AN ELASTOMERIC PRESSURE CUSHION

The invention relates to a sealing body on a support, which is intended more especially for bridges or similar supporting structures and comprises an elastomeric pressure cushion, for sealing the pressure cushion with respect to a movement clearance between parts of the support enclosing the pressure cushion, the sealing body being composed of individual, preferably laminated sealing elements which are arranged side by side and are embedded in the pressure cushion and have sealing surfaces which rest against the support parts.

On a known sealing body which is divided into individual laminae (German Patent Specification No. 2,305,749), it presents difficulties to align the laminae evenly when they are embedded in the pressure cushion.

The task underlying the invention therefore is to provide a divided sealing body whose sealing elements improve the known laminae in that their embedding in the pressure cushion is facilitated, while the movability of the known sealing body is maintained.

According to the invention, this task is solved in that there are formed on the sealing element sides which are directed towards one another projections which form contact surfaces and opposite to which there is located a press stud on one side and an eye for engaging a press stud on the other side.

The sealing elements are supported on one another by the contact surfaces, while at least outside the contact surface pressure cushion material enters between the sealing bodies, thus ensuring the firm connection thereof to the pressure cushion. The press-stud type of connection of the sealing elements, so as to form a link chain representing the sealing body, simplifies the production method considerably. Such a link chain can be very easily installed on the circumferential line of the circular production mould for the pressure cushion. At the same time, the reciprocal support provided in the area of the contact surfaces also ensures a uniform orientation of the individual sealing elements during the production of the pressure cushion.

A further development of the above solution consists in that the projections extend as far as the sealing surfaces resting against the support surfaces. By this means, there are provided self-contained sealing surfaces which adjoin the clearance. The result is a sealing body which is closed upstream of the movement clearance and is movable in itself and is capable of participating in any deformation of the pressure cushion without being squeezed or worn. Since the movement clearances, particularly those of cup-shaped supports, are generally circular, a particularly advantageous further development consists in that, in adaptation to the radius of the movement clearance and to the sealing element width measured in the direction of this radius, the contact surfaces are arched in the same sense. The curvature of the arch should be such that the reciprocal support of the sealing elements on the circular movement clearance is kept approximately between 40 and 120 cm for all usual support diameters. The outer stepped line of the narrow sealing elements is adapted without problem to the roundness of the movement clearance under the prevailing pressures by plastic deformation.

According to a further feature, a particularly intimate interlocking with the pressure cushion, along with a simultaneous saving in material, can be brought about in that the sealing elements each comprise an open cavity at their ends which are remote from the movement clearance. This cavity can extend to such an extent that it will also comprise the area of the press-stud/eye connection. In this way, the individual sealing elements sit in the pressure cushion like teeth in the jaw. An additional interlocking with the pressure cushion is brought about in that the sealing elements comprise extensions which extend away from the movement clearance and are bound in the pressure cushion. Such a development in the manner of a toothing provides a gradual transition between the pressure cushion and the sealing body. In this way, any abrasion phenomena, caused by deformation due to the movement of the support, in the connection zone between the pressure cushion and the sealing body are largely avoided.

Figure 1:
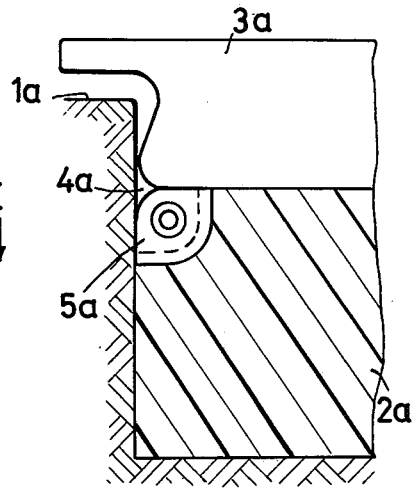
Figure 3:
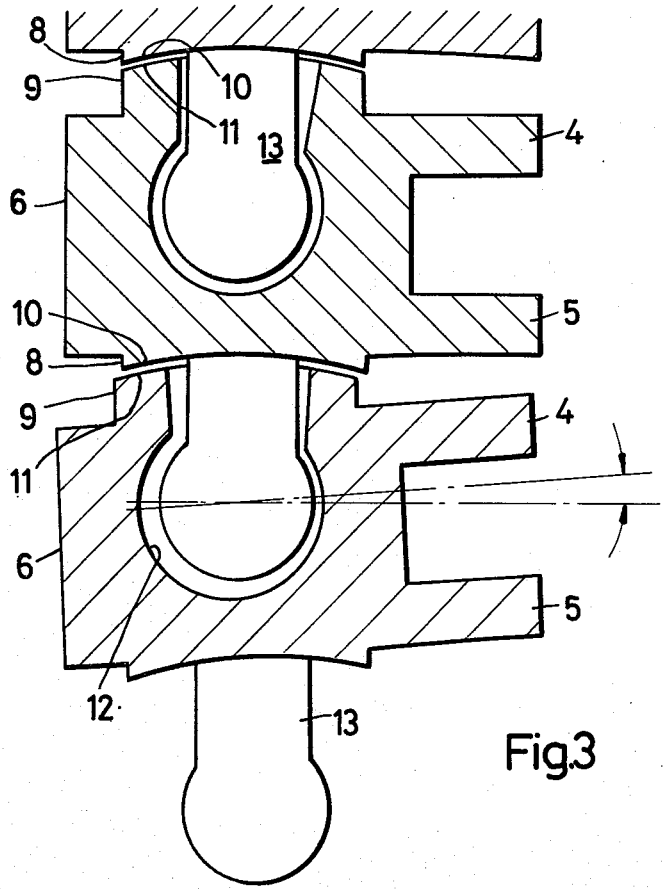

An exemplified embodiment of the invention will be explained hereafter with reference to the drawings, in which:

FIG. 1 shows a vertical cross section through a cup-shaped support as a cut-out in the area of a movement clearance, FIG. 2 shows a sealing element in cross section, and FIG. 3 shows a section through several sealing elements in the plane III—III of FIG. 2.

A cup-shaped support of the kind shown in FIG. 1 consists, for example, of a support cup 1*a*, which is filled with a rubber pressure cushion 2*a*, on which a support cover 3*a*, which is movable towards every side, is supported under the support load. Between the cover portion engaging in the support cup 1*a* and the cup wall, there is provided a circular movement clearance 4*a* which is sealed by means of a sealing body 5*a*. The sealing body thus prevents the emergence of any pressure cushion material; it therefore has to be arranged in a circular manner in front of the support clearance.

The construction of the sealing body in detail emerges from FIGS. 2 and 3. FIG. 2 shows a lateral view of individual sealing elements which, being laterally lined against one another in a plurality, provide the sealing body 5*a*. The individual sealing element 6 comprises sealing surfaces 1 and 2 which adjoin the support parts and are connected to each other through a rounded portion 3. On the side that is remote from the movement clearance 4*a*, the sealing element comprises extensions 4 and 5 which project into the pressure cushion and ensure an effective interlocking with the pressure cushion. The extensions 4 and 5 extend in the shape of an arch in the area of the angle formed by the sealing surfaces 1 and 2, which is approximately 90° in the illustration shown. On the side shown in FIG. 2, the sealing element comprises an eye 12 in the shape of a peg hole for the entry of a matching peg-shaped press stud 13 of the next following sealing element. Each sealing element thus comprises a press stud on one side and an eye on the other side, so that juxtaposed sealing elements are connected to one another by way of this press stud/eye connection. Once this connection has been established, they are supported on their lateral contact surfaces 10 and 11. The contact surfaces 10 and 11 are formed on projections 8 and 9 of the sealing elements; they are curved cylindrically in the same sense, i.e. the design of the contact surface 11 of one side is convex and that of the other contact surface 10 is accordingly concave. The eye 12 and the press stud 13 are arranged approximately in the centre of the contact surfaces 10 and 11. The cavity formed between the extensions 4 and 5 results in a saving in material and a particularly intimate interlocking with the pressure cushion material.

We claim:

1. An assembly for sealing the clearance between the pressure cushion and adjacent parts of the support structure of a bridge or the like comprising a plurality of sealing elements which are arranged side by side and at least partially embedded in the pressure cushion and include sealing surfaces which rest against a part of the surface of the support structure and ends which are directed towards one another, said ends being formed with conforming projections which form contact surfaces, one of said surfaces having a press stud and the other of said surfaces an eye for receiving said press stud.

2. The assembly as claimed in claim 1, wherein said projections extend along sides of each sealing element a distance coextensive with the sealing surfaces of the sealing element engaging with the contiguous surfaces of the support structure.

3. The assembly as claimed in claim 1 or 2, wherein the clearance is annular and the said contact surfaces are curved to conform to the radius of said clearance and the width of the sealing element measured in the direction of such radius.

4. The assembly as claimed in claim 3, wherein the contact surfaces of adjacent sealing elements are given complementary convex and concave configurations.

5. The assembly as claimed in claim 1, wherein the side of each said sealing element remote from the side engaging the support is provided with an open cavity.

6. The assembly as claimed in claim 5, wherein each of said sealing elements include extensions which project in a direction away from said clearance and define said open cavity, said extension being embeddable in the pressure cushion.

7. The assembly as claimed in claim 6, wherein said extensions adjoin the sealing surfaces of its sealing element which rest against the adjacent parts of the support structure.

8. The assembly as claimed in claim 2, wherein the sealing surfaces of each sealing element are connected to one another by a curved portion.

9. The assembly as claimed in claim 1, wherein said press stud and eye are configured and dimensioned to afford rotary movement in the plane of the clearance.

10. The assembly as claimed in claim 9, wherein said press stud and eye are arranged approximately in the center of the contact surfaces of the respective sealing elements.

* * * * *